US006208958B1

(12) United States Patent
Cho et al.

(10) Patent No.: US 6,208,958 B1
(45) Date of Patent: Mar. 27, 2001

(54) PITCH DETERMINATION APPARATUS AND METHOD USING SPECTRO-TEMPORAL AUTOCORRELATION

(75) Inventors: Yong-duk Cho, Suwon; Moo-Young Kim, Sungnam, both of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/226,115

(22) Filed: Jan. 7, 1999

(30) Foreign Application Priority Data

Apr. 16, 1998 (KR) ..... 98-13665

(51) Int. Cl.[7] ..... G10L 13/02

(52) U.S. Cl. ..... 704/207; 704/263; 704/267; 704/268; 704/217; 704/216

(58) Field of Search ..... 704/209, 200.1, 704/207, 216, 217, 220, 219, 224, 263, 267, 268

(56) References Cited

U.S. PATENT DOCUMENTS

| | | | | |
|---|---|---|---|---|
| 5,365,592 | * | 11/1994 | Horner et al. | 704/205 |
| 5,619,004 | * | 4/1997 | Dame | 811/616 |
| 5,799,271 | * | 8/1998 | Byun et al. | 704/217 |
| 5,822,732 | * | 10/1998 | Tasaki | 704/268 |
| 5,911,128 | * | 6/1999 | DeJaco | 704/221 |
| 6,041,297 | * | 3/2000 | Goldberg | 704/219 |
| 6,047,254 | * | 4/2000 | Ireton et al. | 704/209 |

* cited by examiner

*Primary Examiner*—David Hudspeth
*Assistant Examiner*—Vijay B Chawan
(74) *Attorney, Agent, or Firm*—Burns, Doane, Swecker & Mathis, L.L.P.

(57) ABSTRACT

A pitch determination apparatus and method using spectro-temporal autocorrelation to prevent pitch determination errors are provided. The pitch determination apparatus using spectro-temporal autocorrelation includes a formant bandwidth extension unit for extending a formant bandwidth to reduce the influence of the first formant with respect to an input voice, a temporal autocorrelation calculation unit for calculating an autocorrelation value of a time axial voice within a candidate pitch range with respect to a time axial speech signal output from the formant bandwidth extension unit, a spectral autocorrelation calculation unit for transforming the time axial speech signal output from the formant bandwidth extension unit into a frequency axial signal, and calculating an autocorrelation value between frequency axis amplitude spectrums within the candidate pitch range, an autocorrelation value synthesis unit for summing the autocorrelation values obtained by the temporal and spectral autocorrelation calculation units and obtaining a spectro-temporal autocorrelation value, and a pitch determination unit for determining a pitch having a maximum spectro-temporal autocorrelation value as a final pitch. According to this apparatus, pitch determination errors are reduced by determining a pitch using the temporal and spectral autocorrelation values, thus improving the quality of speech communication.

10 Claims, 4 Drawing Sheets

PITCH DETERMINATION APPARATUS AND METHOD USING SPECTRO-TEMPORAL AUTOCORRELATION

This application claims priority under 35 U.S.C. §§119 and/or 365 to 98-13665 filed in Korea on Apr. 16, 1998; the entire content of which is hereby incorporated by reference.

BACKGROUND OF THE INVENTION

1. Field of the Invention

The present invention relates to speech signal processing, and more particularly, to a pitch determination apparatus and method which is used in a voice coder of a low bit rate, a voice recognition apparatus, etc.

2. Description of the Related Art

A pitch is generated by periodical characteristics of opening and closing of a vocal cord in the respect of the characteristics of voice production of human being. This pitch is an important parameter which is used upon voice modeling. The pitch is usually applied to, for example, a voice coder (or a vocoder or a voice codec), voice recognition, voice transformation, etc.

In a case of a low bit rate voice decoder, when an error is generated upon pitch determination, the quality of speech communication is significantly deteriorated. Thus, in these application fields, it is very important to select an accurate pitch determination method.

Generally, a pitch determination error can be a pitch doubling, a pitch halving, or a first formant error. In the pitch doubling, an original pitch T is erroneously determined to be 2T, 3T, 4T, . . . In the pitch halving, an original pitch T is erroneously determined to be T/2, T/4, T/8, . . . The first formant error is generated when the autocorrelation of a first formant is greater than the correlation value of a pitch.

FIG. 1 shows a widely-used conventional pitch determination method using autocorrelation at a time axis.

However, in this conventional pitch determination method, an error due to pitch doubling occurs frequently.

For example, when an input voice is the same as FIG. 5A, an autocorrelation value is the same as FIG. 5B. When an original voice pitch is 31, the autocorrelation method provokes an error upon pitch determination since correlation values of candidate pitches 31, 62 and 93 are large.

Accordingly, the conventional pitch determination method using the autocorrelation has a high pitch determination error rate, thus significantly degrading the tone quality of a voice coder. Particularly, when background noise is mixed in an input voice, the tone quality is more deteriorated due to a pitch determination error.

SUMMARY OF THE INVENTION

To solve the above problem, it is an objective of the present invention to provide a pitch determination apparatus and method which uses spectro-temporal autocorrelation to prevent pitch determination errors.

Accordingly, to achieve the above objective, there is provided a pitch determination apparatus using spectro-temporal autocorrelation, comprising: a formant bandwidth extension unit for extending a formant bandwidth to reduce the influence of a first formant with respect to an input voice; a temporal autocorrelation calculation unit for calculating an autocorrelation value of a time axial voice within a candidate pitch range with respect to a time axial speech signal output from the formant bandwidth extension unit; a spectral autocorrelation calculation unit for transforming the time axial speech signal output from the formant bandwidth extension unit into a frequency axial signal, and calculating an autocorrelation value between frequency axis amplitude spectrums within the candidate pitch range; an autocorrelation value synthesis unit for summing the autocorrelation values obtained by the temporal and spectral autocorrelation calculation units and obtaining a spectro-temporal autocorrelation value; and a pitch determination unit for determining a pitch having a maximum spectro-temporal autocorrelation value as a final pitch.

To achieve the above objective, there is provided a method of determining a pitch with respect to an input speech signal using spectro-temporal autocorrelation, comprising the steps of: extending a formant bandwidth to reduce an influence of a first formant with respect to the input speech signal; calculating temporal autocorrelation values with respect to a candidate pitch from a formant-extended speech signal output from the formant bandwidth extension step; calculating spectral autocorrelation values with respect to the candidate pitch from the formant-extended speech signal output from the formant bandwidth extension step; obtaining spectro-temporal autocorrelation values with respect to the candidate pitch using the temporal and spectral autocorrelation values obtained by the above steps; and determining a candidate pitch having a maximum spectro-temporal autocorrelation value as a pitch.

BRIEF DESCRIPTION OF THE DRAWINGS

The above objective and advantage of the present invention will become more apparent by describing in detail a preferred embodiment thereof with reference to the attached drawings in which.

DESCRIPTION OF THE PREFERRED EMBODIMENT

Figure 1:
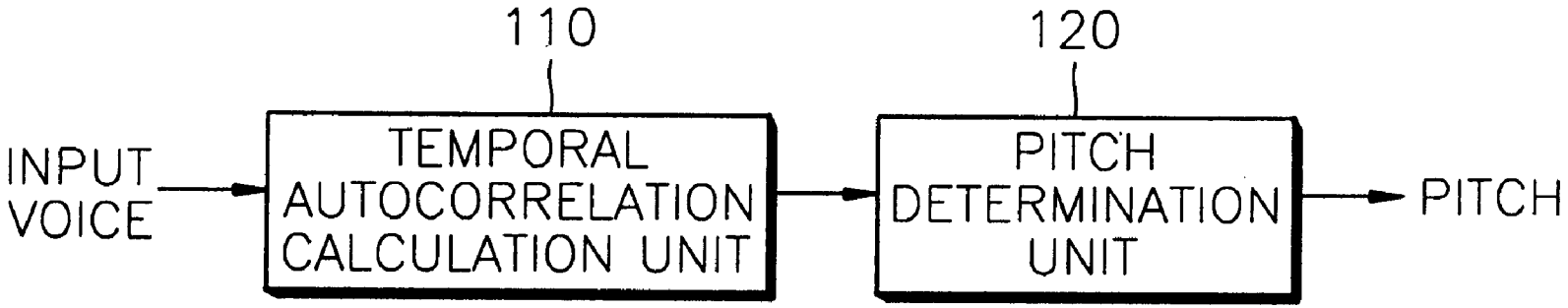
FIG. 1 (PRIOR ART)
FIG. 1 is a block diagram of a conventional pitch determination apparatus.
Figure 2:
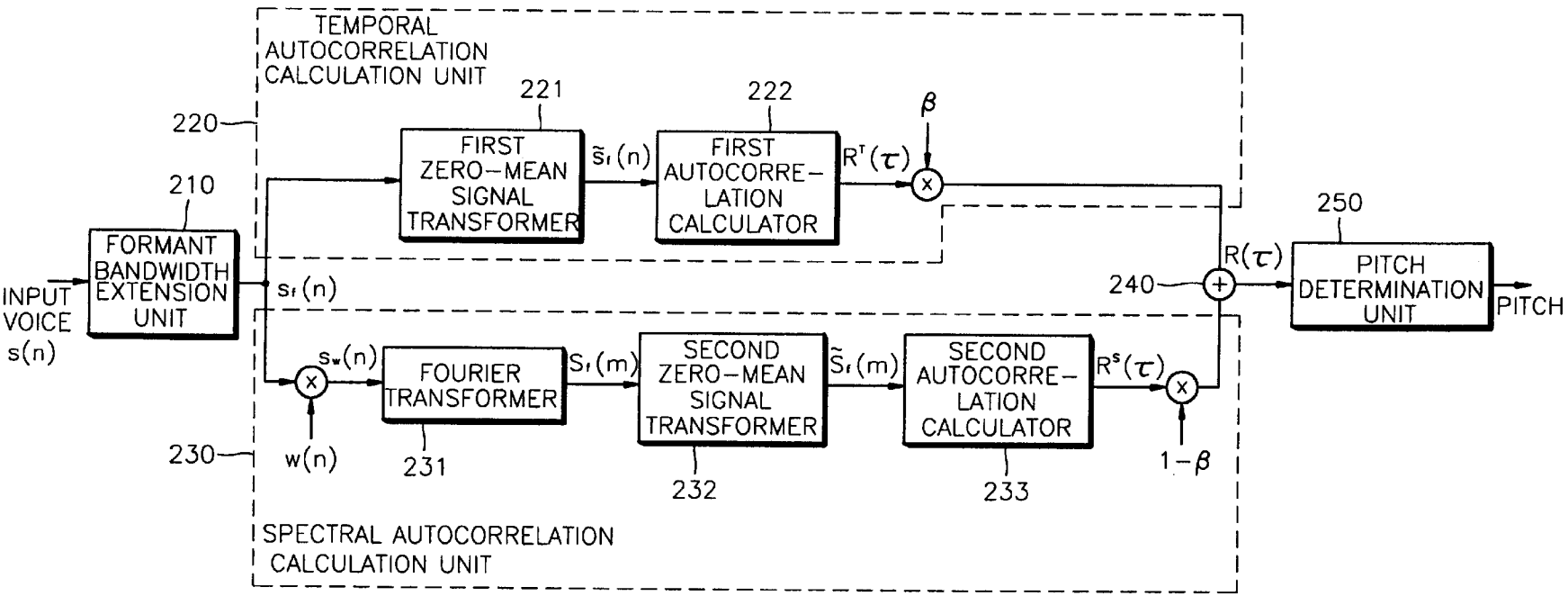
FIG. 2 is a block diagram of a pitch determination apparatus using spectro-temporal autocorrelation, according to a preferred embodiment of the present invention.

Referring to FIG. 2, a pitch determination apparatus using spectro-temporal autocorrelation includes a formant bandwidth extension unit 210, a temporal autocorrelation calculation unit 220, a spectral autocorrelation calculation unit 230, an autocorrelation value synthesization unit 240, and a pitch determination unit The formant bandwidth extension unit 210 extends the bandwidth of a formant to reduce the influence of a first formant.

The temporal autocorrelation calculation unit 220 calculates an autocorrelation value of a time axial speech signal output by the format bandwidth extension unit 210 within a range to which candidate pitches belong, and is comprised of a first zero-mean signal transformer 221, and a first autocorrelation calculator 222. The first zero-mean signal transformer 221 transforms the time axial speech signal output from the formant bandwidth extension unit 210 into a time axial zero-mean signal. The first autocorrelation calculator 222 calculates an autocorrelation value of the time axial zero-mean signal output from the first zero-mean signal transformer 221.

The spectral autocorrelation calculation unit 230 transforms the time axial signal output from the formant bandwidth extension unit 210 into a frequency axial signal, and calculates an autocorrelation value between frequency axis size spectrums within the range to which the candidate pitches belong, and is comprised of a Fourier transformer 231, a second zero-mean signal transformer 232, and a second autocorrelation calculator 233. The Fourier transformer 231 transforms the time axial speech signal output from the formant bandwidth extension unit 210 into a frequency axial speech signal. The second zero-mean signal transformer 232 transforms the frequency axial speech signal output from the Fourier transformer 231 into a zero-mean signal. The second autocorrelation calculator 233 calculates an autocorrelation value of the frequency axial zero-mean signal output from the second zero-mean signal transformer 232.

The autocorrelation value synthesis unit 240 sums the autocorrelation values obtained by the temporal and spectral autocorrelation calculation units 220 and 230, to obtain a spectro-temporal autocorrelation value.

The pitch determination unit 250 determines a pitch having the greatest spectro-temporal autocorrelation value, as a final pitch.

The operation of the present invention will now be described on the basis of the above-described structure.

In the present invention, as a preprocessing of an input voice s(n), the bandwidth of a formant is extended to reduce the influence of a first formant. The extension can be accomplished by using a perceptual weighting filter which is used in a voice coder of a code excited linear prediction family. The input speech s(n) is transformed into a speech signal $s_f(n)$ having an increased formant bandwidth by the perceptual weighting filter used in the formant bandwidth extension unit 210. The perceptual weighting filter is expressed by the following function:

$$F(z) = \frac{1 - \sum_{i=1}^{p} a_i z^{-i}}{1 - \sum_{i=1}^{p} a_i y^i z^{-i}} \tag{1}$$

wherein $a_i$ is a linear prediction coefficient, and γ, being between 0 and 1, can control planarization of a spectrum. $s_f(n)$ is a bypass signal when γ is 1, and is a residual signal of the linear prediction when γ is 0. In the present invention, we can see from an experiment that performance is the most excellent when γ is 0.8.

The first zero-mean signal transformer 221 transforms the speech signal $s_f(n)$ having an extended formant bandwidth into a zero-mean signal $s_f(n)$ using the following Equation 2, to calculate a temporal autocorrelation value with respect to the speech signal $s_f(n)$ having an extended formant bandwidth:

$$s_f(n) = s_f(n) - \frac{1}{N}\sum_{p=0}^{N-1} s_f(p),\ p = 0, 1, \ldots, N-1 \tag{2}$$

wherein N is the number of speech samples.

When the speech signal $s_f(n)$ having an extended formant bandwidth is given, the first autocorrelation calculator 222 calculates the following temporal autocorrelation value in a candidate pitch (T):

$$R_T(T) = \frac{\sum_{n=0}^{N-T-1} s_f(n)s_f(n+T)}{\sqrt{\sum_{n=0}^{N-T-1} s_f(n)^2 \sum_{n=0}^{N-T-1} s_f(n+T)^2}} \tag{3}$$

The spectral autocorrelation is an autocorrelation value of a speech spectrum on a frequency axis. The Fourier transformer 231 applies a window w(n) to the speech signal $s_f(n)$ having an extended formant bandwidth, and obtains an amplitude response according to each frequency as follows:

$$S_f(m) = \left|\sum_{n=0}^{N-1} w(n)s_f(n)e^{-j2\pi mn/N}\right|,\ m = 0, 1, \ldots, N-1 \tag{4}$$

The second zero-mean signal transformer 232 transforms the output of the Fourier transformer 231 into a zero-mean signal of an amplitude spectrum $S_f(m)$ as follows, to calculate a spectral autocorrelation value:

$$S_f(m) = S_f(m) - \frac{1}{N}\sum_{n=0}^{N-1} S_f(n),\ m = 0, 1, \ldots, N-1 \tag{5}$$

The second autocorrelation calculator 233 calculates an autocorrelation value between amplitude spectrums $S_f(m)$ as follows:

$$R_S(T) = \frac{\sum_{m=0}^{M-\omega_T-1} S_f(m)S_f(m+\omega_T)}{\sqrt{\sum_{m=0}^{M-\omega_T-1} S_f(m)^2 \sum_{m=0}^{M-\omega_T-1} S_f(m+\omega_T)^2}} \tag{6}$$

wherein $\omega_\tau$ is round (2M/T), and $S_f(m)$ is a zero-mean signal of $S_f(m)$.

The autocorrelation synthesis unit 240 obtains a spectro-temporal autocorrelation value in the candidate pitch (T) as follows, using the temporal autocorrelation value obtained by the temporal autocorrelation calculation unit 220 and the spectral autocorrelation value obtained by the spectral autocorrelation calculation unit 230:

$$R(T) = \beta R_T(T) + (1-\beta)R_S(T) \tag{7}$$

wherein β is a weighted value between 0 and 1.

Finally, the pitch determination unit 250 determines a pitch having a maximum R(T) value. T* is a T value when R(T) is maximum.

$$T^* = \arg\max R(T) \tag{8}$$

Figure 3:
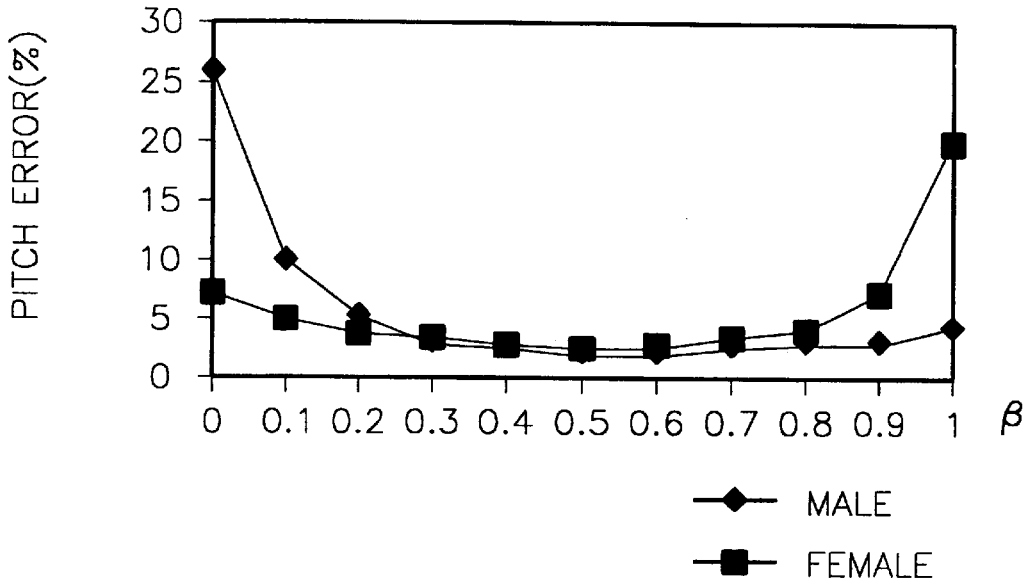
FIG. 3 is a graph illustrating a comparison between performances according to a weighted value.
Figure 4:
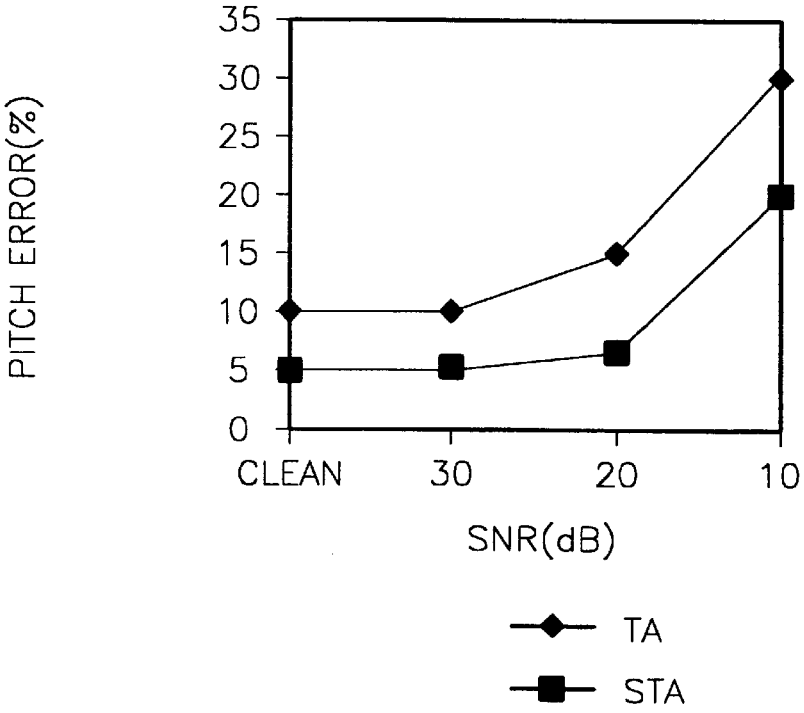
FIG. 4 is a graph illustrating a comparison between pitch errors of a voice spoken under an automobile noise environment.

When a change in the pitch (T) value is observed by observing the vocalization characteristics of human being, the pitch (T) value is usually between 20 and 140. When β is 1, the above-described autocorrelation is the same as a conventional autocorrelation. FIG. 3 shows results of observed performance according to a change in the β value. According to the analysis of FIG. 3, when β is 0.5, a pitch error rate is the lowest. That is, we can see that performance is remarkably improved, compared to the conventional autocorrelation. FIG. 4 shows the results of analyzing performance after mixing automobile noise in voice. We can verify that the spectro-temporal autocorrelation (STA) proposed to the present invention is exceedingly superior to the conventional temporal autocorrelation.

Figure 5A:
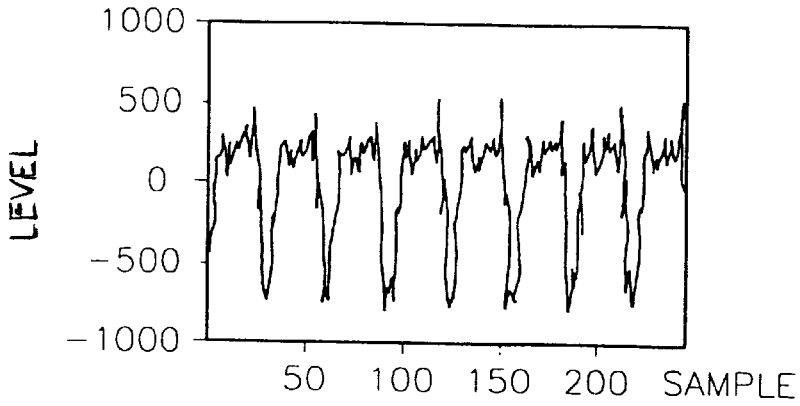
FIG. 5A shows a sample of an input voice.
Figure 5B:
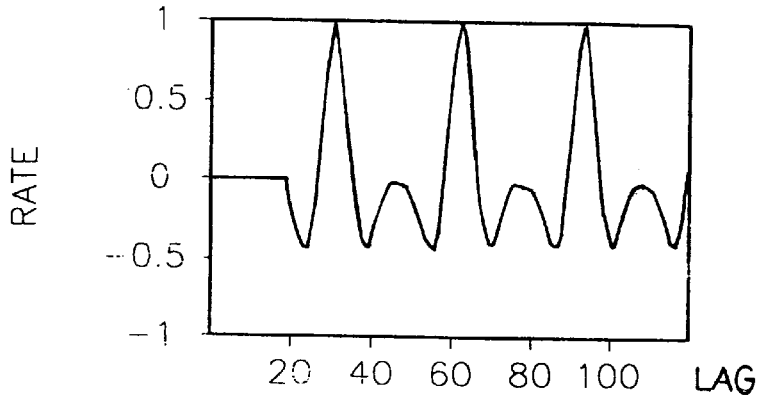
FIG. 5B shows temporal autocorrelation values according to candidate pitches.
Figure 5C:
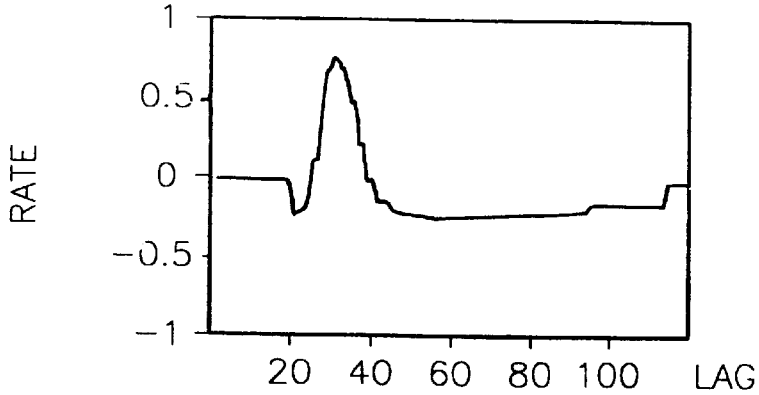
FIG. 5C shows spectral autocorrelation values according to candidate pitches.
Figure 5D:
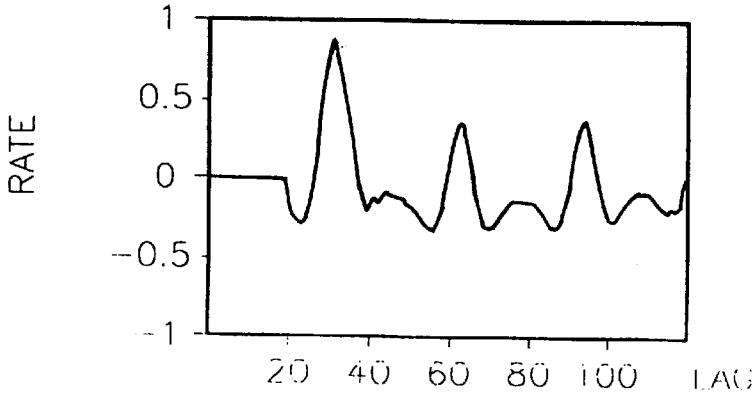
FIG. 5D shows spectro-temporal autocorrelation values according to candidate pitches.

The reason why the pitch determination method according to the present invention obtains superior performance to the conventional pitch determination method will now be described referring to FIGS. 5A through 5D. FIG. 5B shows an autocorrelation value when the conventional method is used, i.e., according to a change in the candidate pitch. It can be seen that in the conventional pitch determination method, discrimination is low since the autocorrelation value is significantly high at the candidate pitches 31, 62 and 93. That is, pitch error (pitch doubling error) is highly likely to be generated. FIG. 5C shows spectral autocorrelation values according to a change in the candidate pitch. In the characteristics of the spectral autocorrelation value, when an original pitch is T, an autocorrelation value is large at T/2, T/4, . . . That is, a pitch halving error is prone to occur (in FIG. 3, T/2 is 15.5 and is not included in a search section since a pitch search range is 20 or more). FIG. 5D illustrates a change in the spectro-temporal autocorrelation value according to the change in candidate pitch. The present correlation value is a weighted sum of the temporal autocorrelation value of FIG. 5B and the spectral autocorrelation value of FIG. 5C, as shown in Equation 7. As shown in FIG. 5D, the autocorrelation value is very large at the original pitch of 31, but is relatively small at the candidate pitches of 62 and 93. Thus, we can see that the pitch determination method according to the present invention has superior discrimination to the conventional pitch determination method.

According to the present invention, pitch determination errors are reduced by determining a pitch using temporal and spectral autocorrelation values, thus improving the quality of speech communication.

What is claimed is:

1. A pitch determination apparatus using spectro-temporal autocorrelation, comprising:

a formant bandwidth extension unit for extending a formant bandwidth to reduce the influence of a first formant with respect to an input voice;

a temporal autocorrelation calculation unit for calculating an autocorrelation value of a time axial voice within a candidate pitch range with respect to a time axial speech signal output from the formant bandwidth extension unit;

a spectral autocorrelation calculation unit for transforming the time axial speech signal output from the formant bandwidth extension unit into a frequency axial signal, and calculating an autocorrelation value between frequency axis amplitude spectrums within the candidate pitch range;

an autocorrelation value synthesis unit for summing the autocorrelation values obtained by the temporal and spectral autocorrelation calculation units and obtaining a spectro-temporal autocorrelation value; and a pitch determination unit for determining a pitch having a maximum spectro-temporal autocorrelation value as a final pitch.

2. The pitch determination apparatus using spectro-temporal autocorrelation as claimed in claim 1, wherein the formant bandwidth extension unit extends the formant bandwidth using a perceptual weighting filter.

3. The pitch determination apparatus using spectro-temporal autocorrelation as claimed in claim 2, wherein the perceptual weighting filter is realized as follows:

$$F(z) = \frac{1 - \sum_{i=1}^{p} a_i z^{-i}}{1 - \sum_{i=1}^{p} a_i \gamma^i z^{-i}}$$

(here, $a_i$ is a linear prediction coefficient, and γ, being between 0 and 1, can control planarization of a spectrum).

4. The pitch determination apparatus using spectro-temporal autocorrelation as claimed in claim 1, wherein the temporal autocorrelation calculation unit comprises:

a first zero-mean signal transformer for transforming the time axial speech signal output by the formant bandwidth extension unit into a zero-mean signal; and a first autocorrelation calculator for calculating an autocorrelation value of a candidate pitch using the time axial zero-mean signal output by the first zero-mean signal transformer.

5. The pitch determination apparatus using spectro-temporal autocorrelation as claimed in claim 1, wherein the spectral autocorrelation calculation unit comprises:

a Fourier transformer for transforming the time axial speech signal output by the formant bandwidth extension unit into a frequency axial speech signal;

a second zero-mean signal transformer for transforming the frequency axial speech signal output by the Fourier transformer into a zero-mean signal; and a second autocorrelation calculator for calculating an autocorrelation value of a candidate pitch using the frequency axial zero-mean signal output by the second zero-mean signal transformer.

6. A method of determining a pitch with respect to an input speech signal using spectro-temporal autocorrelation, comprising the steps of:

extending a formant bandwidth to reduce an influence of a first formant with respect to the input speech signal;

calculating temporal autocorrelation values with respect to a candidate pitch from a speech signal whose formant bandwidth is extended;

calculating spectral autocorrelation values with respect to the candidate pitch from the speech signal whose formant bandwidth is extended;

obtaining spectro-temporal autocorrelation values with respect to the candidate pitch using the temporal and spectral autocorrelation values; and determining a candidate pitch having a maximum spectro-temporal autocorrelation value as a pitch.

7. The pitch determination method using spectro-temporal autocorrelation as claimed in claim 6, wherein the temporal autocorrelation value calculation step comprises:

a first zero-mean calculation step of calculating a zero-mean signal of sf(n), being a speech signal having an extended formant, using the following Equation:

$$s_f(n) = s_f(n) - \frac{1}{N}\sum_{p=0}^{N-1} s_f(p),\ p = 0, 1, \ldots, N-1$$

wherein N is the number of voice samples; and a first autocorrelation calculation step of calculating a temporal autocorrelation value with respect to a candidate pitch (T) of $s_f(n)$, being a speech signal having an extended formant, using the following Equation:

$$R_T(T) = \frac{\sum_{n=0}^{N-T-1} s_f(n)s_f(n+T)}{\sqrt{\sum_{n=0}^{N-T-1} s_f(n)^2 \sum_{n=0}^{N-T-1} s_f(n+T)^2}}$$

wherein N is the number of speech samples.

8. The pitch determination method using spectro-temporal autocorrelation as claimed in claim 6, wherein the spectral autocorrelation value calculation step comprises:

a Fourier transform step of obtaining amplitude responses according to the frequency of $s_f(n)$, being a speech signal having an extended formant, using the following Equation:

$$S_f(m) = \left|\sum_{n=0}^{N-1} w(n)s_f(n)e^{-j2\pi mn/N}\right|,\ m = 0, 1, \ldots, N-1$$

a second zero-mean calculation step of obtaining a zero-mean signal of an amplitude spectrum $S_f(m)$ obtained by the Fourier transform step using the slowing Equation:

$$S_f(m) = S_f(m) - \frac{1}{N}\sum_{n=0}^{N-1} S_f(n), \quad m = 0, 1, \ldots, N-1$$

a second autocorrelation calculation step of obtaining a spectral autocorrelation value with respect to the candidate pitch (T) from the speech signal having an extended formant, using the following Equation:

$$R_s(\tau) = \frac{\sum_{m=0}^{M-\omega_\tau-1} S_f(m)S_f(m+\omega_\tau)}{\sqrt{\sum_{m=0}^{M-\omega_\tau-1} S_f(m)^2 \sum_{m=0}^{M-\omega_\tau-1} S_f(m+\omega_\tau)^2}}$$

wherein $\omega_\tau$ is round (2M/T).

9. The pitch determination method using spectro-temporal autocorrelation as claimed in claim 7, wherein in the spectro-temporal autocorrelation value calculation step, when the candidate pitch is T, the spectro-temporal autocorrelation value with respect to the candidate pitch is obtained from the speech signal having an extended formant, using the following Equation:

$$R(T)=\beta R_{T)+(1-\beta)R_S}(T).$$

wherein β is a weighted value, and a pitch error rate varies according to the β values.

10. The pitch determination method using spectro-temporal autocorrelation as claimed in claim 8, wherein in the spectro-temporal autocorrelation value calculation step, when the candidate pitch is T, the spectro-temporal autocorrelation value with respect to the candidate pitch is obtained from the speech signal having an extended formant, using the following Equation:

$$R(T)=\beta R_T(T)+(1-\beta)R_S(T)$$

wherein β is a weighted value, and a pitch error rate varies according to the β values.

* * * * *